US009222681B2

(12) United States Patent
Nijenhuis

(10) Patent No.: US 9,222,681 B2
(45) Date of Patent: Dec. 29, 2015

(54) FLAME ARRESTING GREASE FILTER

(75) Inventor: Marcellinus Gerardus Jozef Nijenhuis, Enschede (NL)

(73) Assignee: GREASE CAPTURE, INC., Palm City, FL (US)

( * ) Notice: Subject to any disclaimer, the term of this patent is extended or adjusted under 35 U.S.C. 154(b) by 649 days.

(21) Appl. No.: 12/857,791

(22) Filed: Aug. 17, 2010

(65) Prior Publication Data

US 2011/0042110 A1 Feb. 24, 2011

(30) Foreign Application Priority Data

Aug. 20, 2009 (EP) ..... 09168290

(51) Int. Cl.
*A62C 35/02* (2006.01)
*F24C 15/20* (2006.01)
*A62C 3/00* (2006.01)

(52) U.S. Cl.
CPC ..... *F24C 15/2035* (2013.01); *A62C 3/006* (2013.01)

(58) Field of Classification Search
CPC ..... F24C 15/2035; A62C 3/006
USPC ..... 169/65; 55/320, 440, 442, 443, 444; 454/49
See application file for complete search history.

(56) References Cited

U.S. PATENT DOCUMENTS 872,453 A 12/1907 Reid
1,059,910 A * 4/1913 Russell et al. ..... 181/264
1,532,473 A * 4/1925 Byrne ..... 239/288
2,045,135 A * 6/1936 Hanson ..... 181/268
5,177,962 A * 1/1993 Hall et al. ..... 60/311
5,336,083 A 8/1994 Rajewski
6,656,244 B1 * 12/2003 Galassi ..... 55/444
6,776,814 B2 * 8/2004 Badeau et al. ..... 55/385.3
7,166,140 B2 * 1/2007 Entezarian et al. ..... 55/320
7,585,345 B2 9/2009 Smasal et al.
2006/0157048 A1 7/2006 Heilman
2007/0234688 A1 * 10/2007 Cheng ..... 55/354

FOREIGN PATENT DOCUMENTS

DE 9311478 U1 9/1993
WO WO/9629549 * 9/1996

OTHER PUBLICATIONS

NFPA 96—Standard for Ventilation Control and Fire Protection of Commercial Cooking Operations, 2011 Edition, pp. 1-44, Quincy, MA.
Greenheck Inc, Grease-X-Tractor Specification Sheet, Apr. 2014.
(Continued)

*Primary Examiner* — Arthur O Hall
*Assistant Examiner* — Viet Le
(74) *Attorney, Agent, or Firm* — Brian E. Szymanski

(57) ABSTRACT

The invention relates to a device for arresting flames in a gas flow, for example in a kitchen hood, the device includes at least two substantially parallel spaced apart fire proof sheets, wherein the sheets are provided with perforated zones, wherein at least a channel is formed by a perforated zone of the sheet upstream of the gas flow, the space between the at least two sheets and a perforated zone of the sheet downstream of the gas flow, wherein the channel includes a section which has a reverse direction relative to the gas flow.

13 Claims, 5 Drawing Sheets

(56) References Cited

OTHER PUBLICATIONS

Intertek Testing Services NA, Inc., Test Report No. 100725253SAT-001A, Jun. 14, 2012.

Particle Capture Efficiency Determination for Grease Capture, Inc. GCF-001 Grease Filter, Final Report, Department of Mechanical Engineering, University of Minnesota, Jul. 30, 2012.

* cited by examiner

FLAME ARRESTING GREASE FILTER

The invention relates to a device for arresting flames in a gas flow, for example in a kitchen hood.

The kitchen hood present above a stove will suck fumes, grease and gasses away into a duct. If a flame occurs in a pan on the stove the kitchen hood will try to suck the flames into the duct. As a duct generally is lined with combustible material such as grease, the risk is present that the sucked in flames will ignite the combustible material and will set the duct on fire.

It is known in the prior art to provide the kitchen hood with grease filtration and extraction devices. These devices also contribute to reducing the chance of flames getting into the duct. However, if the grease filtration and extraction devices are not cleaned frequently, the grease in these devices could be ignited if the device is heated to a temperature of about 300° C.

The NFPA (National Fire Protection Association) 96 standard requires that the installed grease exhaust systems should be cleaned to bare metal. Proper inspection and maintenance is the key in eliminating fire damage to the ducts.

Although prior art grease filtration devices partially remove grease from the gas flow and accordingly reduces the amount of grease in the ducts, the devices do not arrest flames. The prior art devices only provide a barrier which delays the flames, but does not stop them.

A prior art grease filtration device is shown in FIG. 1. This device 1 comprises a number of gutters 2, 3, which respectively are open at the top and at the bottom. A gas flow 4 coming from below will be split in several sub flows 5, which will meander along the gutters 2, 3. Due to this meandering the particles. like grease particles, in the sub flows 5 will get in contact with the gutters 2, 3 and generally condensate on the surface of these gutters 2, 3. The condensed grease can than flow through the gutters 2, 3 to a collection device.

However, sparks in the gas flow 4 resulting from for example flames, can pass the device 1 and can get in to the outgoing gas flow 6. If the heat is sufficient in the outgoing gas flow, a spark could simply ignite the gas flow and set the downstream duct system in fire.

It is an object of the invention to provide a grease filtration device, which also arrests flames and sparks.

This object is achieved with a device according to the invention, which device comprises at least two substantially parallel spaced apart fire proof sheets, wherein the sheets are provided with perforated zones, wherein at least a channel is formed by a perforated zone of the sheet upstream of the gas flow, the space between the at least two sheets and a perforated zone of the sheet downstream of the gas flow, wherein the channel comprises a section which has a reverse direction relative to the gas flow.

The device according to the invention effectively arrests flames, by forcing the gas flow through perforated zones in the fire proof zones. When the gas flow goes through the perforations a lot of heat is transferred in to the sheets which cools the gasses and stops any flames. Furthermore, the channel section in reverse direction ensures that additional air is added to the gas mixture, making a very lean gas mixture which is more difficult to ignite. Finally, the second fire proof sheet with perforated zones further cools down the gas mixture.

Besides the flame arresting property of the invention, the fire proof sheets with perforated zones also provide a grease filtering function. As the gas flow is forced through the channel section with reverse direction, the particles in the gas flow will get in contact with the sheets and condensate at the surface of the sheets.

In a preferred embodiment of the device according to the invention the fire proof sheets are undulated having an equal wavelength. Due to the undulations a channel section with reversed direction can easily be manufactured. Preferably the crests of both undulating sheets contact each other and the troughs of both undulating sheets contact each other. As a result a number of separate channels are created between the two sheets.

In another embodiment of the invention the fire proof sheets are metal sheets, preferably stainless steel sheets. Metal sheets can easily be machined and also have the property of a good heat transfer.

Yet another embodiment of the invention comprises downstream of the gas flow a diffuser plate. This diffuser plate provides an equal flow of gas through the downstream duct system reducing hot spots in the gas flow. The diffuser plate also extracts further heat from the gas flow. Similarly, a diffuser plate could be arranged upstream to provide for an equal flow of the gases entering the device.

In another preferred embodiment of the device according to the invention the formed at least one channel has a width equal to the width of the device and is provided at both ends in width direction with openings for a supply of air. The air at the boundaries of the device is cooler than the gas flow, because this gas flow results from a burner of a stove, while the air at the boundaries is ambient air. Due to the gas flow and the temperature difference, the ambient air will be dragged into the at least one channel and will mix with the gas flow, reducing the temperature and making the mixture leaner. Recycled cooler process air could also be used instead of ambient air.

In still another embodiment of the device according to the invention the holes of the perforated zones have an area of less than 2 $mm^2$. It has proven that with holes having an area of less than 2 $mm^2$, sparks cannot pass the holes.

The invention further relates to a kitchen hood comprising a channel, a fan arranged in the channel for discharging gases and a device according to the invention.

Preferably the device is tilted in width direction for discharging condensate.

These and other features of the invention, will be elucidated in conjunction with the accompanying drawings.

Figure 3A:
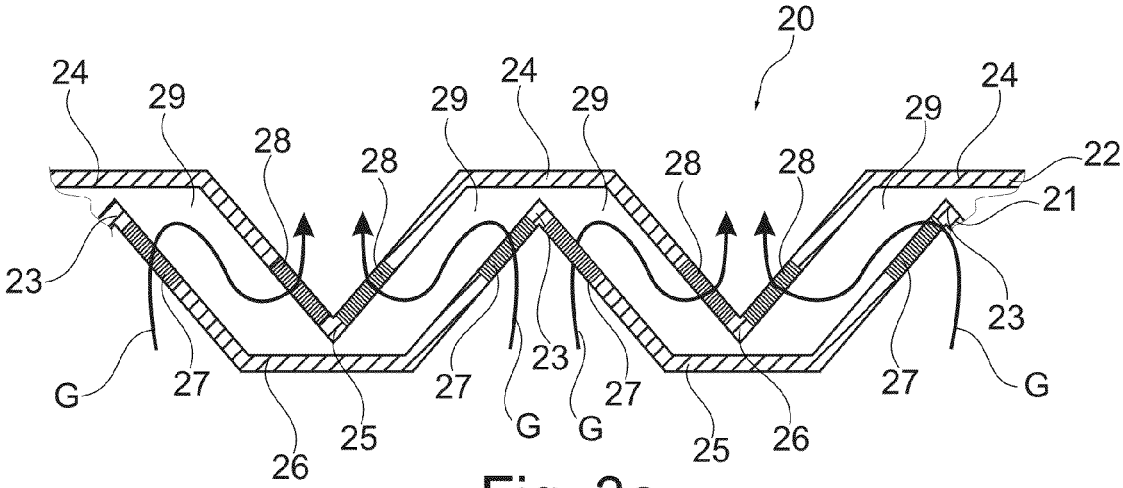
Figure 3B:
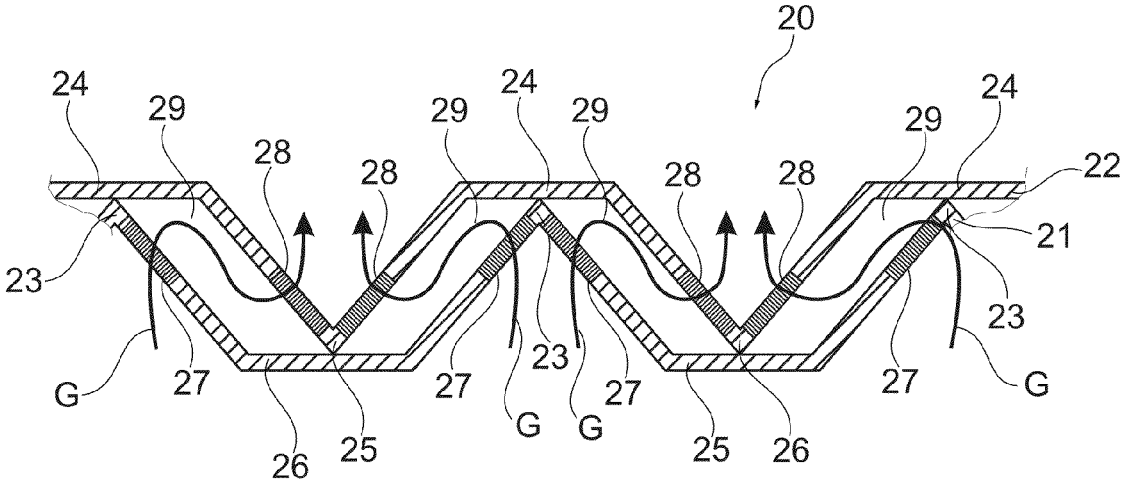

FIGS. 3*a* and 3*b* depict a cross sectional view of two embodiments.

Figure 4:
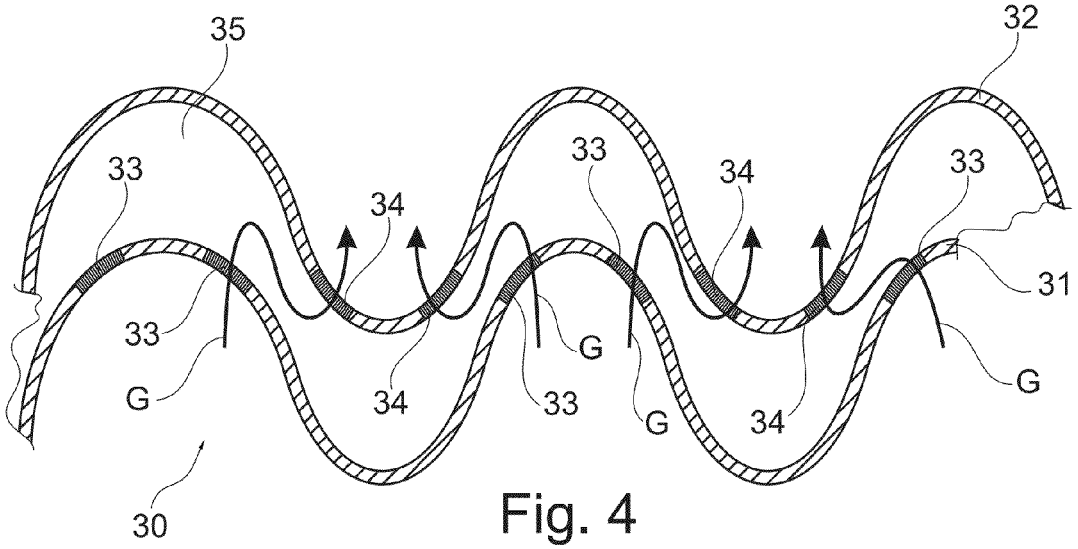

FIG. 4 shows a cross sectional view of a second embodiment of a device according to the invention.

Figure 5:
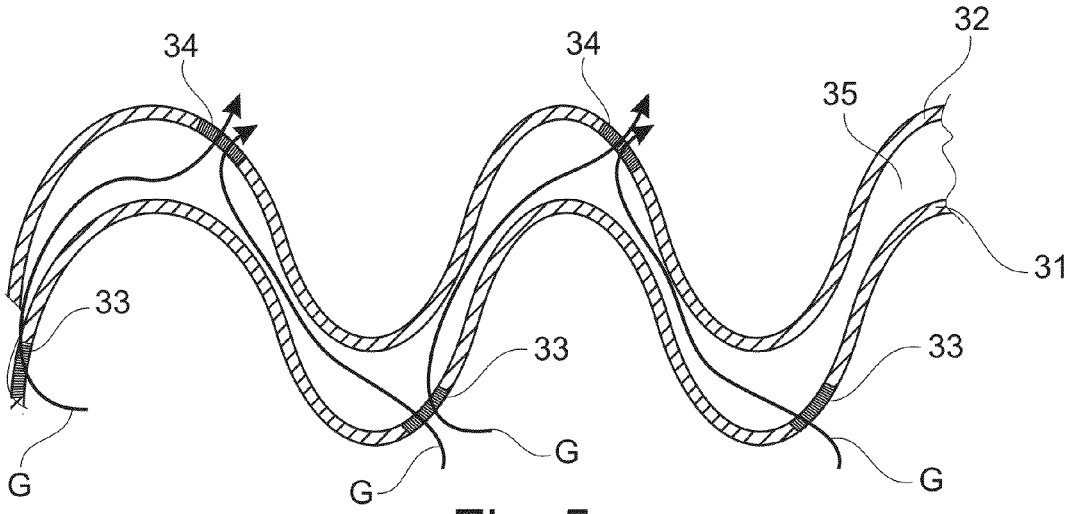

FIG. 5 shows a variant of the second embodiment according to FIG. 4.

Figure 6:
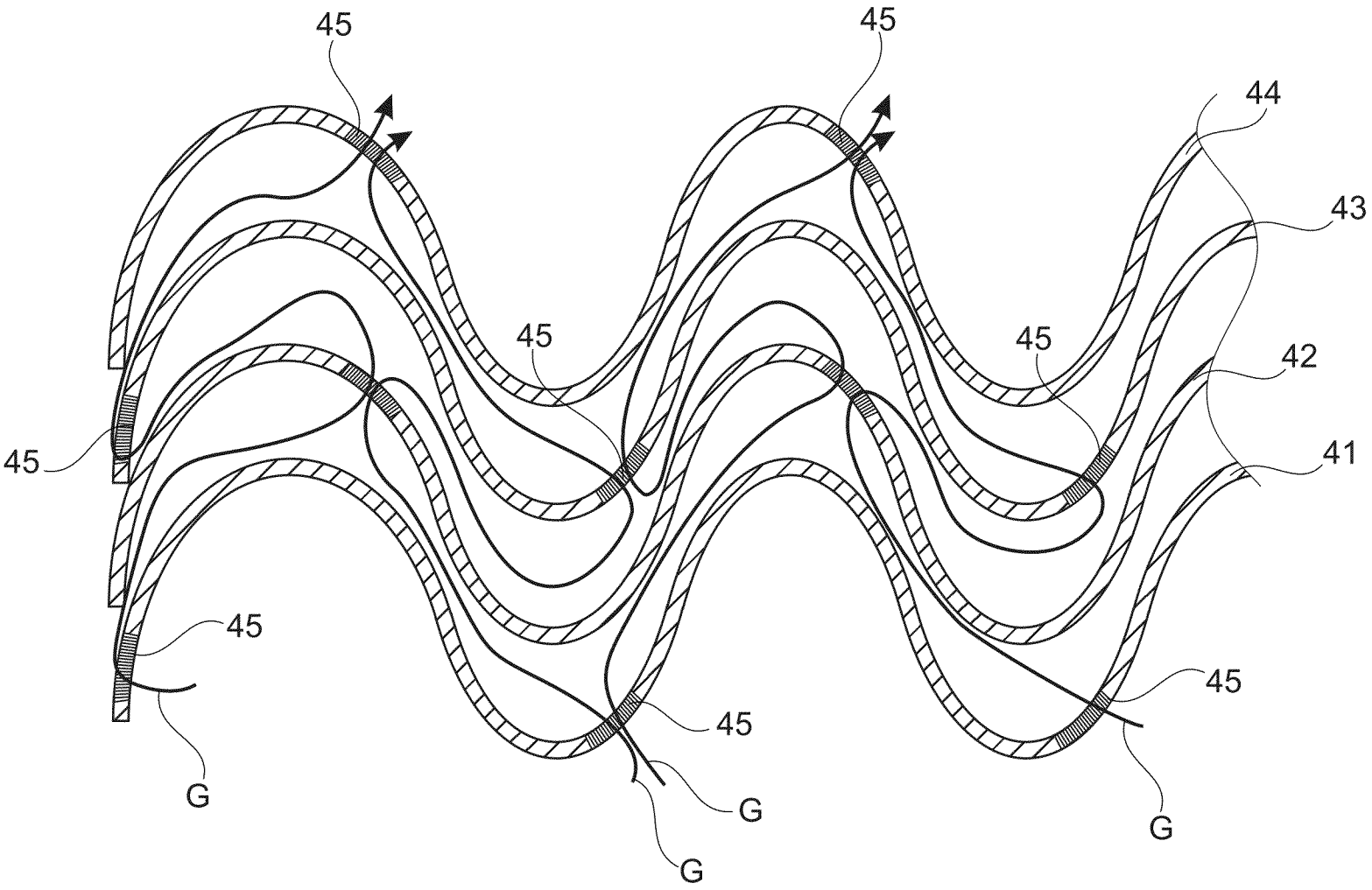

FIG. 6 shows a further variant of FIG. 5.

Figure 1:
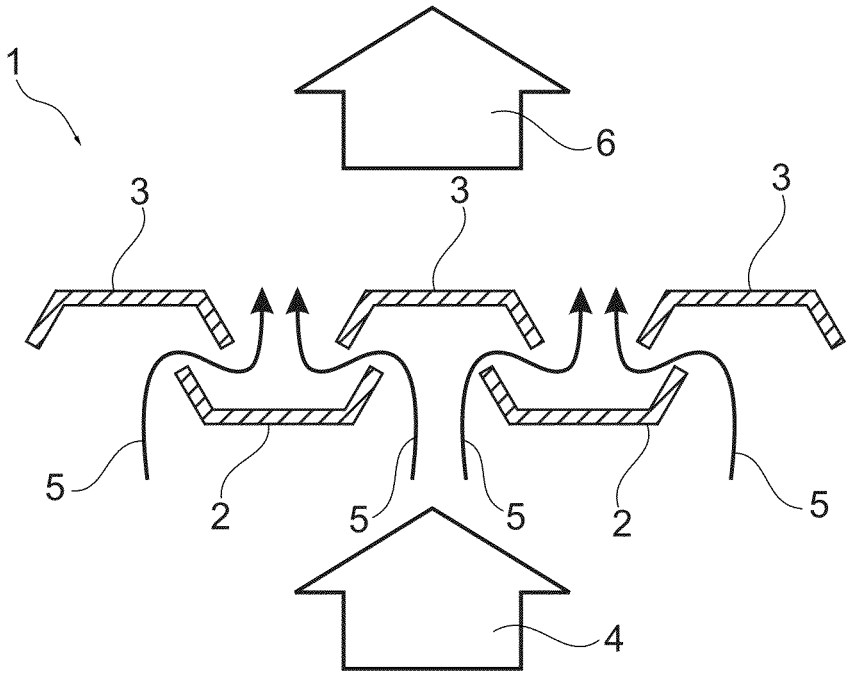
Fig. 1 PRIOR ART
FIG. 1 shows a schematic view of a prior art grease filtration device.
Figure 2:
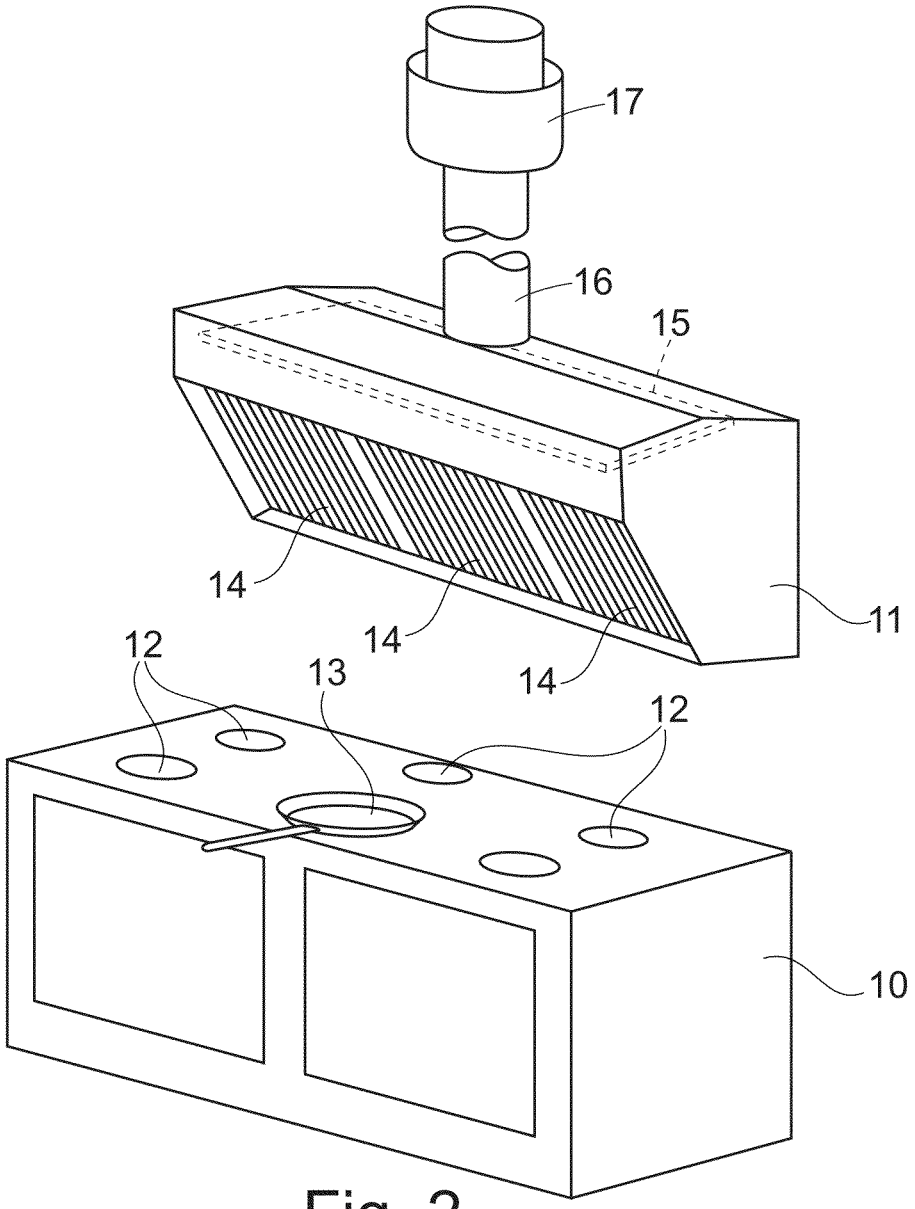
FIG. 2 shows a perspective view of a stove and an embodiment of a kitchen hood according to the invention.

FIG. 2 shows in perspective view a stove 10 with a kitchen hood 11 suspended above the stove 10. The stove 10 is provided with burners 12 on which a pan 13 can be placed.

The kitchen hood 11 is provided with a fan 17 for sucking in gasses from the cooking at the stove 10 and discharging the gasses to a duct system 16. The kitchen hood 11 is provided with devices 14 for arresting flames, which could occur in the pan 13 during cooking. A diffuser 15 may also be included in the kitchen hood 11.

FIG. 3 shows a cross sectional view of a first embodiment 20 of a device according to the invention. This embodiment can be arranged in the hood 11 shown in FIG. 2.

According to FIG. 3*b*, the device 20 comprises an upstream sheet 21 and a downstream sheet 22. Both sheets 21, 22 are undulated and arranged on top of each other, such that the crests 23 of sheet 21 contact the crests 24 of sheet 22 and such that the troughs 25 of sheet 21 contact the troughs 26 of sheet 22.

Each sheet 21, 22 is respectively provided with perforated zones 27, 28 respectively. These perforated zones 27, 28 extend in lengthwise direction, perpendicular to the shown cross section.

The gas flow G from the stove enters the device through the perforated zones 27 of the sheet 21. The sheet 21 will withdraw heat from this gas flow G. The flow then enters the channel section 29, which has a reverse direction seen in the general gas flow direction, i.e. the channel section 29 has a downward direction, while the general gas flow is up.

The gas flow G then leaves the device 20 through the perforated zones 28, where the gas flow again leaves heat in the sheet 22. This results in a substantial reduction of the temperature of the gas flow G.

Furthermore, the channel sections 29 extend in lengthwise direction perpendicular to the shown cross section. At the ends of these lengthwise channels, ambient air is supplied, which mixes with the gas flow G making it a leaner mixture which is less likely to ignite.

Grease which is transported by the gas flow G will contact the inner walls of the sheets 21, 22 due to the meandering flow of the gas G. The grease will condensate on these walls 21, 22. As the device 20 is under an angle, as can be seen in FIG. 2, the lengthwise channels run downwards. The grease can accordingly drip downwardly along these channels and can be collected at the bottom of the kitchen hood 11.

FIG. 4 shows a second embodiment 30 of a device according to the invention. This embodiment has two parallel undulating sheets 31, 32. The upstream sheet 31 is provided with perforated zones 33 near the crests of the undulating form, while the downstream sheet 32 is provided with perforated zones 34 near the troughs of the undulating form.

As a result of the configuration of the sheets 31, 32 and perforated zones 33, 34, the gas flow G enters the embodiment 30 via zones 33, reverses direction in the channel 35 and leaves the embodiment 30 via zones 34. At each pass-through of the gas flow G through a zone 33, 34 the temperature of the flow G is reduced, as heat is transferred into the sheets 31, 32.

In FIG. 5 a variant of the embodiment 30 in FIG. 4 is shown. In this variant the perforated zones 33, 34 of the sheets 31, 32 respectively have been positioned differently, such that the channel 35 is longer and the gas flow G has a longer retention time to exchange heat.

If the safety margin and the capture of grease and dust should be increased further, additional sheets 41, 42, 43, 44 with perforated zones 45 can be arranged (see FIG. 6). By arranging further sheets the length of the path, which the gas flow travels through the device, is further increased. As a result the retention time is increased and the amount of heat exchanged between the gas flow and the sheets is increased, resulting in a lower temperature of the exiting gas flow. Also the amount of grease and pollutants capture is increased in the device by the additional sheets.

A filter material can additionally be arranged in between two sets of at least two sheets. This filter material increases the grease and dust filtering properties. If a filter material would be added to the embodiment of FIG. 6, the layer of filter material would be placed between the sheets 42 and 43.

Preferably the size of the holes of the perforated zones 27, 28, 33, 34 is designed such, that sparks cannot go through these holes. This reduces further the risk of re-igniting the gas flow G after it leaves the device 30.

The invention claimed is:

1. A device for arresting sparks or flames in a gas flow, the device comprising:

(a) at least two spaced apart fire proof sheets, wherein each of the at least two spaced apart fire proof sheets are undulated having an equal wavelength with crests and troughs, and wherein the fire proof sheets have perforated zones, wherein a location of the perforated zones alternates for each fire proof sheet in succession of the at least two spaced apart fire proof sheets between a position near the crests of one fire proof sheet to a position near the troughs of an opposing fire proof sheet;

(b) at least one channel permitting gas flow, the at least one channel formed by (i) a perforated zone of a one fire proof sheet upstream of the gas flow, (ii) the space between the at least two spaced apart fire proof sheets, and (iii) a perforated zone of another fire proof sheet downstream of the gas flow, and (c) wherein the channel at least partially redirects gas flow in a path different than a path of the gas flow prior to entering the channel, and wherein the gas flow exits the perforated zone of the fire proof sheet downstream of the gas flow.

2. The device according to claim 1, wherein the fire proof sheets are undulated having an equal wavelength.

3. The device according to claim 2, wherein the crests of both undulating sheets contact each other and the troughs of both undulating sheets contact each other.

4. The device according to claim 1, wherein the fire proof sheets are metal sheets.

5. The device according to claim 1, comprising a diffuser plate downstream of the gas flow.

6. The device according to claim 1, wherein the device has an end that is open to at least one channel for a supply of air.

7. A device according to claim 1, wherein the perforated zones have holes sized to prevent the passage of sparks, flames or combinations thereof.

8. A kitchen ventilation system comprising a hood, a device according to claim 1 arranged in the hood, a duct connected to the hood and a fan arranged in the duct for creating a gas flow through the device and discharging the gas flow at an outlet of the duct, wherein the gas flow into the device is laden with combustible materials and the combustible materials are substantially removed from the gas flow by the device.

9. The kitchen hood according to claim 8, wherein the device is tilted in a width direction for discharging condensate.

10. A device according to claim 1, wherein the gas flow contains combustible materials and at least a portion of the combustible materials condense on the fire proof sheets.

11. A device according to claim 10, wherein the combustible materials are collected from the device.

12. A device according to claim 1, wherein the gas flow exhibits a temperature drop after passing through the device.

13. The device according to claim 7, wherein each of the holes of the perforated zones have an area of less than 2 $mm^2$.

* * * * *